US006754618B1

(12) United States Patent
Konstantinides et al.

(10) Patent No.: US 6,754,618 B1
(45) Date of Patent: Jun. 22, 2004

(54) FAST IMPLEMENTATION OF MPEG AUDIO CODING

(75) Inventors: Konstantinos Konstantinides, San Jose, CA (US); Shaomei Chen, San Jose, CA (US); Linjun Zhou, Santa Clara, CA (US)

(73) Assignee: Cirrus Logic, Inc., Austin, TX (US)

( * ) Notice: Subject to any disclaimer, the term of this patent is extended or adjusted under 35 U.S.C. 154(b) by 551 days.

(21) Appl. No.: 09/589,612

(22) Filed: Jun. 7, 2000

(51) Int. Cl.[7] ..... G10L 19/00
(52) U.S. Cl. ..... 704/200.1; 704/500
(58) Field of Search ..... 704/200.1, 500, 704/501

(56) References Cited

U.S. PATENT DOCUMENTS

| | | | | | |
|---|---|---|---|---|---|
| 5,388,181 | A | * | 2/1995 | Anderson | 704/200.1 |
| 5,481,614 | A | * | 1/1996 | Johnston | 381/2 |
| 5,592,584 | A | * | 1/1997 | Ferreira | 704/203 |
| 5,649,053 | A | * | 7/1997 | Kim | 704/229 |
| 5,694,153 | A | * | 12/1997 | Aoyagi | 345/161 |
| 5,721,806 | A | * | 2/1998 | Lee | 704/229 |
| 5,790,759 | A | * | 8/1998 | Chen | 704/200.1 |
| 5,909,664 | A | * | 6/1999 | Davis | 704/229 |
| 5,930,758 | A | * | 7/1999 | Nishiguchi | 704/500 |
| 5,956,674 | A | * | 9/1999 | Smyth | 704/200.1 |
| 5,974,380 | A | * | 10/1999 | Smyth | 704/229 |
| 6,161,088 | A | * | 12/2000 | Li | 704/299 |
| 6,308,150 | B1 | * | 10/2001 | Neo | 704/200.1 |
| 6,430,529 | B1 | * | 8/2002 | Huang | 704/229 |
| 6,430,534 | B1 | * | 8/2002 | Bett | 704/500 |

OTHER PUBLICATIONS

Bhaskaran, Vasudev and Konstantinides, Konstantinos, *Image and Video Compression Standards Alorithms and Architectures*, pp. 364–372, Kluwer Academic Publishers, Boston Massachusetts 1997.

Van Dijk, Boudewijn and Nijboer, Jaap G., , "Principles and Standards of Optical Disc Systems"*Digital Consumer Electronics Handbook*pp. 11.1–11.29, McGraw Hill, 1997.

Smolenski, Michael, Fink, Torsten, Konstantinides, Konstatninos, Frankenberger, David and Peplinski, Chuck, "Design of a Personal Digital Video Recorder/Player".

Chen, C.T., Chen, T.C., Jeng, F–C and Konstantinieds, K., "A Single–Chip MPEG–2 Audio/Video Encoder/Decoder".

Chen, C.T., Chen, T.C., Feng, C., Huang, C–C, Jeng, F–C, Konstatinides, K. Lin, F.–H., Smolenski, M. and Haly, E., "A Single–Chip MPEG–2 Video Encoder/Decoder for Consumer Applications" (Conference material).

"Super VCD Recorder/Player", Version 2, Oct. 1, 1999.

* cited by examiner

*Primary Examiner*—Richemond Dorvil
*Assistant Examiner*—Kinari Patel
(74) *Attorney, Agent, or Firm*—Maryam Imam, Esq.; Steven Lin, Esq.

(57) ABSTRACT

A communication system is disclosed in one embodiment of the present invention to include an encoder circuit responsive to an audio signal for performing compression on the audio signal and adaptive to generate an audio output signal based upon the compressed audio signal, the encoder circuit for sampling the audio signal to generated sampled signals, each sampled signals having a real and an imaginary component associated therewith, each sampled signal having an energy and a phase defined within a current block and each sampled signal being transformed to have a real and an imaginary component, a previous block preceding the current block and a block preceding the previous block, the encoder circuit for calculating the phase of the samples of the current block using the real and the imaginary components of the samples of the previous block and the block preceding the previous block, wherein calculations for determining the unpredictability measure is reduced by avoiding trigonometric calculations of the sampled signals of the current block thereby improving system performance.

22 Claims, 6 Drawing Sheets

| QUANTIZATION INDEX | C | D | GROUPING/ SAMPLES PER CODEWORD | BITS PER CODEWORD |
|---|---|---|---|---|
| 0 | 1.33333333333 | 0.50000000000 | YES/3 | 5 |
| 1 | 1.60000000000 | 0.50000000000 | YES/3 | 7 |
| 2 | 1.14285714286 | 0.25000000000 | NO/1 | 3 |
| 3 | 1.77777777777 | 0.50000000000 | YES/3 | 10 |
| 4 | 1.06666666666 | 0.12500000000 | NO/1 | 4 |
| 5 | 1.03225806452 | 0.06250000000 | NO/1 | 5 |
| 6 | 1.01587301587 | 0.03125000000 | NO/1 | 6 |
| 7 | 1.00787401575 | 0.01562500000 | NO/1 | 7 |
| 8 | 1.00392156863 | 0.00781250000 | NO/1 | 8 |
| 9 | 1.00195694716 | 0.00390625000 | NO/1 | 9 |
| 10 | 1.00097751711 | 0.00195312500 | NO/1 | 10 |
| 11 | 1.00048851979 | 0.00097656250 | NO/1 | 11 |
| 12 | 1.00024420024 | 0.00048828125 | NO/1 | 12 |
| 13 | 1.00012208522 | 0.00024414063 | NO/1 | 13 |
| 14 | 1.00006103888 | 0.00012207031 | NO/1 | 14 |
| 15 | 1.00003051851 | 0.00006103516 | NO/1 | 15 |
| 16 | 1.00001525902 | 0.00003051758 | NO/1 | 16 |

FIG. 6

FAST IMPLEMENTATION OF MPEG AUDIO CODING

BACKGROUND OF THE INVENTION

1. Field of the Invention

The present invention relates generally to the field of encoding and decoding audio information and particularly to the encoders and decoders employing the MPEG standard for audio information.

2. Description of the Prior Art

In modern communication systems there is an increasing demand for transfer and dissemination of greater quantities of information at faster speeds. In order to transfer greater quantities of information at ever increasing speeds without sacrificing accuracy, data compression is performed at the point of origination and data system. Compression and decompression result in a simpler format for the information to be transmitted thereby increasing the speed and efficiency of the transmission process.

Data compression is effected by employing a variety of encoding techniques presently available. Each of the encoding techniques results in a specific format for the compressed data. When the encoded information is transferred to the destination point, data decompression is performed by decoding the transmitted data in order to retrieve the original information. The process of encoding and decoding must be fast enough to allow for real-time presentation of data in such cases as in the transmission of audio and video information.

Digital audio is a basic component of any video or multimedia application. Due to the large bandwidth occupied by digital audio in any such application, compression of the audio data is an important part of the encoding process. Audio compression is generally performed by taking into consideration the characteristics of the audio signal and the human perception system as embodied in a psychoacoustic model. There are two main high-fidelity audio compression techniques: the Motion Picture Expert Group (MPEG) audio standard and the Dolby Digital audio compression algorithms developed by the Dolby Laboratories.

FIG. 1(*a*) shows a block diagram of an MPEG encoder for a single audio channel. In multichannel systems the same process is repeated for each channel. The audio input 12 consisting of pulse code modulated (PCM) samples, each having a precision of 16 to 24 bits, is shown to constitute the input to the encoder 10. The PCM samples are sampled at 32, 44.1 or 48 KHz frequency. The first stage of the encoder 10 is the analysis filterbank 14 which maps the input signal from the time domain into the frequency domain. The analysis filterbank 14 consists of 32 band-pass filters each of which is a 512-tap band-pass filter.

In addition, based on the frequency characteristics of the input signal and the desired bit rate of the compressed signal, the perceptual model 20 estimates the masking thresholds. Masking threshold is a sound pressure level below which the human ear is less sensitive so that any noise or distortion introduced by the encoder becomes almost imperceptible. For example, in the frequency domain a faint signal may be completely masked if it is in the vicinity of louder signals with similar frequency content. The masking thresholds are used in the quantization and coding step 16 as described hereinbelow.

The output of each subband filter is normalized by the scaling factors that will be transmitted as part of the compressed bitstream. Scaling factors correspond to the maximum absolute value of every twelve consecutive output values in each subband. The output of the analysis filterbank 14 is quantized in the quantization and coding step 16 in such a way that all quantization noise is below the masking thresholds thereby being almost imperceptible to the human ear. Finally, the quantized subband samples, the scaling factors and the bit-allocation information are multiplexed in the bitstream encoding step 18 and transmitted as the compressed stream output 22.

FIG. 1(*b*) shows a block diagram of an MPEG decoder 30 used in recovering the PCM audio samples from the encoded data. The encoded bitstream 24 is shown in FIG. 1(*b*) as input to the decoder 30. At the step frame unpacking 26 of decoding the encoded bitstream 24 is parsed and various pieces of coding information such as scaling factors and bit allocation information are demultiplexed. Subsequently, at the reconstruction step 28 the bit allocation information is decoded and the scaling factors are extracted. The bit allocation information is decoded and the scaling factors are used to requantize the coded samples. Finally, at the step inverse mapping 34 the mapped samples are transformed back into the PCM output 32 corresponding to the input signal of the encoder 10.

Some of the steps used in the encoding process are computationally intensive. For example, the analysis filterbank step 14 and the perceptual model step 20 in the encoder flowchart 10 require intensive computations commonly performed by a fixed-point digital signal processor (DSP). Performing intensive computations requires considerable amount of time severely limiting the performance of the encoder during real-time transmission of audio signals.

One of the quantities to be computed in the perceptual model step 20 is the masking threshold as discussed hereinabove. According to the MPEG audio coding standard ISO/IEC 11172-3, "coding of moving pictures and associated audio for digital storage media at up to about 1.5 Mbits/s—part 3: Audio," ISO/IEC JTC 1/SC29, May 20, 1993, hereinafter referred to as the MPEG Standard, calculating masking threshold entails evaluating such trigonometric function as sine, cosine and inverse tangent which represents a computationally intensive task for a DSP. Evaluating such trigonometric function is needed in computing the unpredictability measure, which is in turn used in determining the masking threshold as described in detail in the MPEG Standard.

Another difficulty currently encountered in the perceptual model step 20 lies in the huge dynamic range of the input data. The MPEG Standard calls for a coverage of about 101 dB (−5 dB to 96 dB) in dynamic range. Every bit covers 3 dB so that the MPEG Standard requires 34 or more bits of digital representation. However, most fixed-point DSP chips for audio are 16 or 24 bits in data width. Although floating-point DSP chips can accommodate higher data widths, fixed-point DSP chips are by far more prevalent due to their smaller size and lower cost. According, the input data has to be scaled in order to fall within the dynamic range of the DSP architecture.

Scaling factors are used to scale down the large input signals in order to avoid clipping. i.e., cutting off an input signal whose sound energy level extends beyond the dynamic range of the DSP. Once the input data has been scaled down, a particular table in the MPEG Standard is used to determine the absolute threshold value used in computing the masking threshold. However, as the input data is consistently scaled down, too few bits may be assigned to represent the weak signal resulting in the problem of underflow, i.e., losing some of the information carried in the weaker signals.

Moreover, there are limitations currently associated with the decoder 30 in FIG. 1(*b*). One such limitation is in the reconstruction step 28 of the decoding process wherein the coded samples have to be requantized so that a specific number of bits are allocated to each coded sample. Requantization is performed by determining the requantization step from a set of four 16 by 32 tables provided in the MPEG Standard. The four different tables correspond to four different bit rates and sampling frequencies. To each entry in the tables corresponds a set of four number. One of the numbers indicates the number of bits per sample and the rest of the numbers are used in the subsequent inverse mapping step 34. Thus the total number of entries stored in the memory of the decoder corresponds to four 16 by 32 by 4 tables. Thus, considerable memory space has to be devoted to the reconstruction step of the decoding process rendering the decoder less efficient and more expensive.

In light of the above, it is desirable to improve upon the MPEG encoder/decoder by making the various steps in the encoding and decoding process more efficient without sacrificing audio quality. The present invention improves upon various steps in the compression/decompression process by providing more efficient approaches while preserving the audio quality.

SUMMARY OF THE INVENTION

Briefly, a communication system includes an encoder circuit responsive to an audio signal for performing compression on the audio signal and adaptive to generate an audio output signal based upon the compressed audio signal, the encoder circuit for sampling the audio signal to generated sampled signals, each sampled signals having a real and an imaginary component associated therewith, each sampled signal having an energy and a phase defined within a current block and each sampled signal being transformed to have a real and an imaginary component, a previous block preceding the current block and a block preceding the previous block, the encoder circuit for calculating the phase of the samples of the current block using the real and the imaginary components of the samples of the previous block and the block preceding the previous block, wherein calculations for determining the unpredictability measure is reduced by avoiding trigonometric calculations of the sampled signals of the current block thereby improving system performance.

The foregoing and other objects, features and advantages of the present invention will be apparent from the following detailed description of the preferred embodiments which make reference to several figures of the drawing.

IN THE DRAWINGS

FIG. 1(*b*) shows a block diagram of a prior art MPEG encoder.

FIG. 6 illustrates a table wherein quantization index is employed to obtain requantization information, accordance with the present invention.

DETAILED DESCRIPTION OF THE PREFERRED EMBODIMENTS

Figure 2:
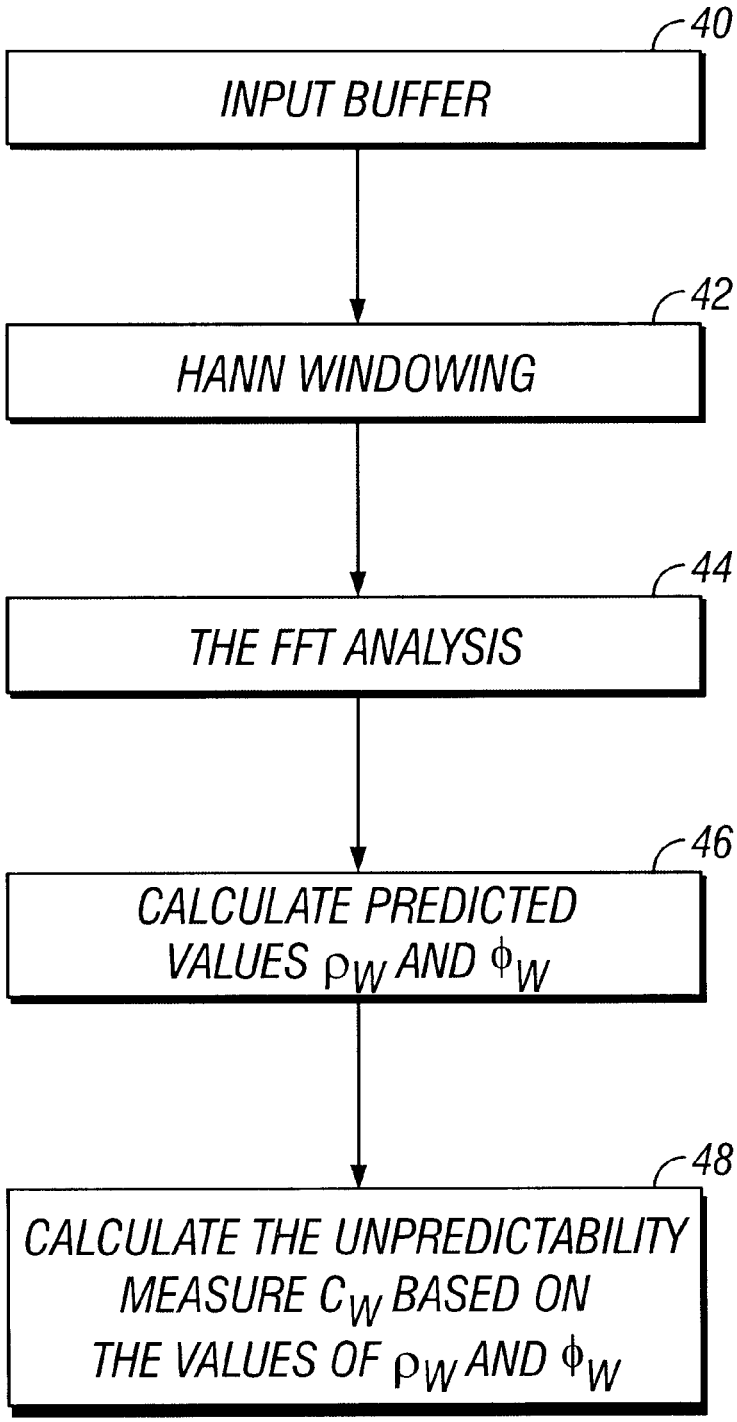
FIG. 2 (Prior Art)
FIG. 2 shows a flowchart outlining various steps in a prior art process of calculating the unpredictability measure of an encoder.

Referring now to FIG. 2, a flowchart outlining various steps in a prior art process of calculating the unpredictability measure $c_w$ used in determining the masking thresholds in the perceptual model of an encoder is shown. The perceptual model used in the encoder is the psychoacoustic model 2 described in the MPEG Standard. According to one embodiment of the present invention calculation of the unpredictability measure $c_w$ in the psychoacoustic model 2 is performed using a new approach wherein a significant reduction in the intensity of computations is achieved. The present approach thereby yields greater efficiency and lower costs as described in detail hereinbelow At step 40 in FIG. 2, the input samples $s_i$, where i represents the index $1 \leqq i \leqq 1{,}024$ of current input sample, are provided to the input buffer of the psychoacoustic model 2. The input samples become available separately at every call to the input buffer and are subsequently concatenated in order to accurately represent the 1,024 consecutive samples of the input signal. Next, at step 42 each input signal s is windowed by a 1,024-point Hann window, i.e., $$sw_i = s_i[0.5 - 0.5 \cos(2\pi(i-0.5)/(1{,}024)]. \quad (1)$$

At step 44 shown in FIG. 2 the complex spectrum of the input samples is calculated using a 1,024-point-fast Fourier transform (FFT). As a result of the FFT analysis, for each $s_i$ two real numbers $x_r(w)$ and $x_j(w)$ are calculated representing the real and imaginary components of the samples $s_i$, respectively. The symbol w denotes the frequency corresponding to the line in the FFT spectral line domain. The frequency w is used to index the FFT spectral lines such that w=1 corresponds to the spectral line at the lowest frequency and w=513 corresponds to the line at the Nyquist frequency, which is twice the maximum frequency component of the input data.

Using the values of $x_r(w)$ and $x_j(w)$ the energy $r^2(w)$ and the phase f(w) of each sample is calculated as $$r(w)^2 = r_w^2 = w_r(w)^2 + x_j(w)^2 \quad (2)$$

$$f(w) = f_w = \tan^{-1}[x_j(w)/x_r(w)] \quad (3)$$

where in equation (3) $\tan^{-1}$ denotes the inverse tangent function. Calculating the phase by equation (3), being the method currently employed in the prior art, is computationally intensive since for evaluating f(w) the inverse tangent function has to be used. However, in the present invention, a new approach is adopted, as described hereinbelow, wherein use of the inverse tangent function is avoided thereby facilitating the computations considerably. The energy and the phase of the samples may alternatively be written as $r_w^2$ and $f_w$, respectively.

The current values of $r_w$ and $f_w$ are used to calculate the predicted values, $\rho_w$ and $\phi_w$ of the square root of the energy and the phase, respectively, at step 46. The predicted values $\rho_w$ and $\phi_w$ are calculated using previous values of $r_w$ and $f_w$ according to $$\rho_w(t) = 2.0 r_w(t-1) - r_w(t-2) \quad (4)$$

$$\phi_w(t)=2.0f_w(t\text{-}1)-f_w(t\text{-}2) \quad (5)$$

where t represents the current block number, t-1 denotes the previous block number and t-2 denotes the block number before that.

At step 48, calculated values of $\rho_w$ and $\phi_w$ are used to evaluate the unpredictability measure $c_w$ as $$c_w=[r_w+\text{abs}(\rho_w)]^{-1}[(r_w \cos f_w-\rho_w \cos \phi_w)^2+(r_w \sin f_w-\rho_w \sin \phi_w)^2]^{1/2} \quad (6)$$

where abs($\rho_w$) denotes the absolute value of $\rho_w$. In prior art, computing equation (6) requires explicit computation of sin, cos, and $\tan^{-1}$ functions. In the present invention the unique relationships among the parameters of equation (6) are taken into consideration to compute $c_w$ without explicit evaluation of any trigonometric functions.

Figure 3:
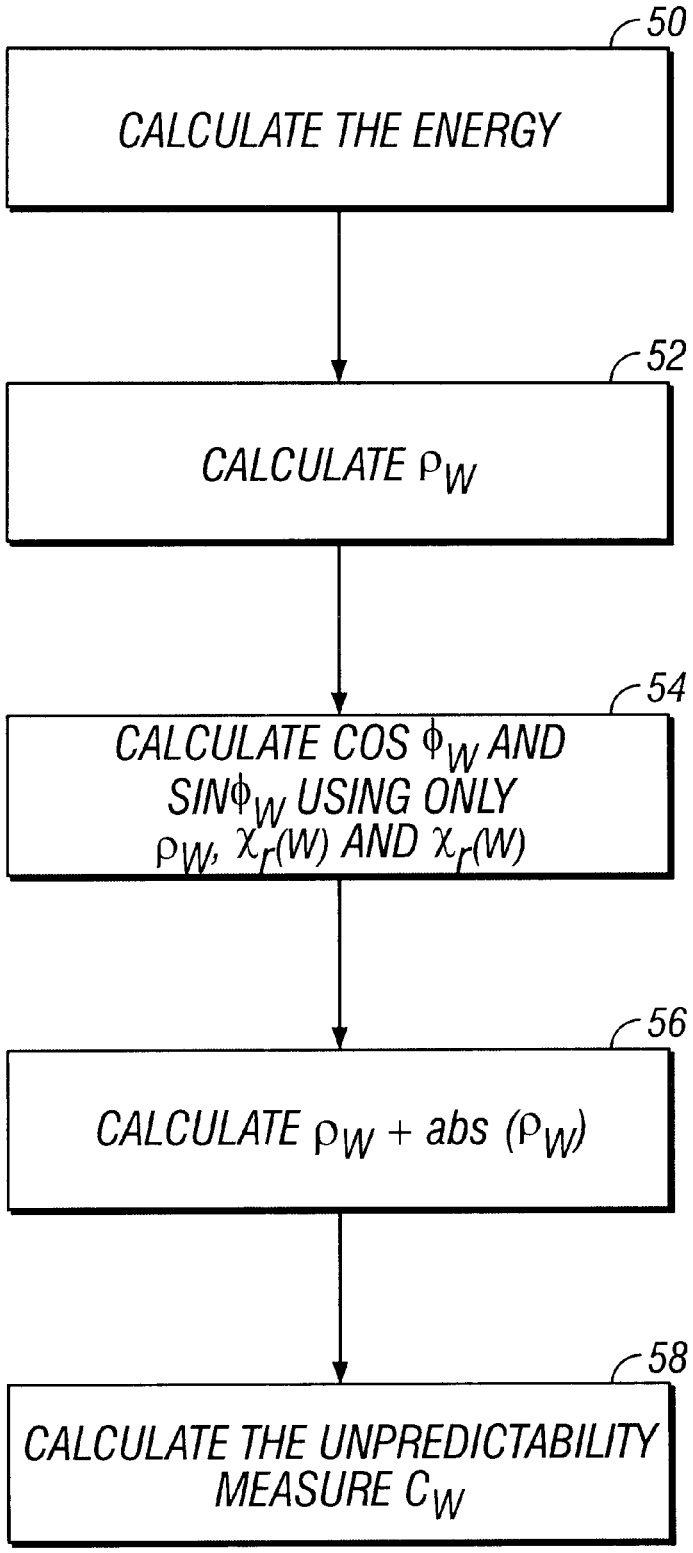
FIG. 3 shows a flowchart outlining various steps in calculation of the unpredictability measure, in accordance with the present invention.

Referring now to FIG. 3 a flowchart outlining the new approach to calculating the unpredictability measure is shown, in accordance to the present invention. At step 50 the energy of each sample is calculated using equation (2). Square root of energy is $r_w$ whose values at previous block numbers t-1 and t-2 are used to calculate $\rho_w$ according to equation (4) as indicated in step 52. However, evaluating the trigonometric function sine and cosine $$\sin f_w=x_j(w)/r_w \quad (7)$$

$$\cos f_w=x_r(w)/r_w \quad (8)$$

respectively, as well as inverse tangent is computationally demanding for the processor and takes up considerable DSP time.

Employing known results of trigonometry in this new approach, sin $2f_w$[t-1] and cos $2f_w$[t-1] are evaluated as $$\cos 2f_w[t\text{-}1]=2(x_r(w)[t\text{-}1])^2/(r_w[t\text{-}1])^2-1 \quad (9)$$

$$\sin 2f_w[t\text{-}1]=2(x_r(w)[t\text{-}1])(x_j(w)[t\text{-}1])/(r_w[t\text{-}1])^2 \quad (10)$$

Using equation (5) sin $\phi_w$[t] and cos $\phi_w$[t] are evaluated at step 54 to be $$\cos \phi_w[t]=\text{temp}\mathbf{1}=(\cos 2f_w[t\text{-}1])(\cos f_w[t\text{-}-2])+(\sin 2f_w[t\text{-}1])(\sin f_w[t\text{-}2]) \quad (11)$$

$$\sin \phi_w[t]=\text{temp}\mathbf{2}=(\sin 2f_w[t\text{-}1])(\cos f_w[t\text{-}-2])-(\cos 2f_w[t\text{-}1])(\sin f_w[t\text{-}2]) \quad (12)$$

where temp1 and temp2 are temporary variables. Substituting equations (7), (8), (9) and (10) into equations (11) and (12), cos $\phi_w$[t] and sin $\phi_w$[t] are evaluated using only $x_r$(W), $x_j$(w) at the indices t-1 and t-2 rather than by explicit evaluation of sine and cosine functions which is a computationally intensive process.

The unpredictability measure $c_w$ given by equation (6) may now be written as $$c_w=[r_w^2+\rho_w^2-2r_w\rho_w \cos(f_w-\phi_w)]^{1/2}/[r_w+\text{abs}(\rho_w)]. \quad (13)$$

The denominator of $c_w$ in equation (13) is evaluated using equation (4) at step 56 as $$\text{temp}\mathbf{3}=r_w+\text{abs}(\rho_w) \quad (14)$$

where temp3 is a temporary variable. By using equations (7), (8), (11) and (12) the numerator of $c_w$ in equation (13) is evaluated by first writing the term $r_w$ cos ($f_w-\phi_w$) as $$\text{temp}\mathbf{4}=(\text{temp}\mathbf{1})x_r(w)+(\text{temp}\mathbf{2})x_j(w) \quad (15)$$

where temp4 is a temporary variable, and then $$\text{temp}\mathbf{5}=r_w^2+\rho_w^2 \quad (16)$$

where temp5 is another temporary variable. Using equations (14), (15) and (16), the unpredictability measure $c_w$ is calculated at step 58 as $$c_w=[\text{temp}\mathbf{5}-2.0\ \rho_w(\text{temp}\mathbf{4})]^{1/2}/(\text{temp}\mathbf{3}) \quad (16a)$$

Evaluating $c_w$ by equation (16a) does not require explicit evaluation of any trigonometric functions such as sine, cosine, inverse tangent and is therefore considerably less intensive in computations than the current method of evaluating $c_w$. The encoding process is more efficient and less costly using the present invention which incorporates equation (16a) into the DSP architecture for evaluating the masking thresholds.

Figure 4:
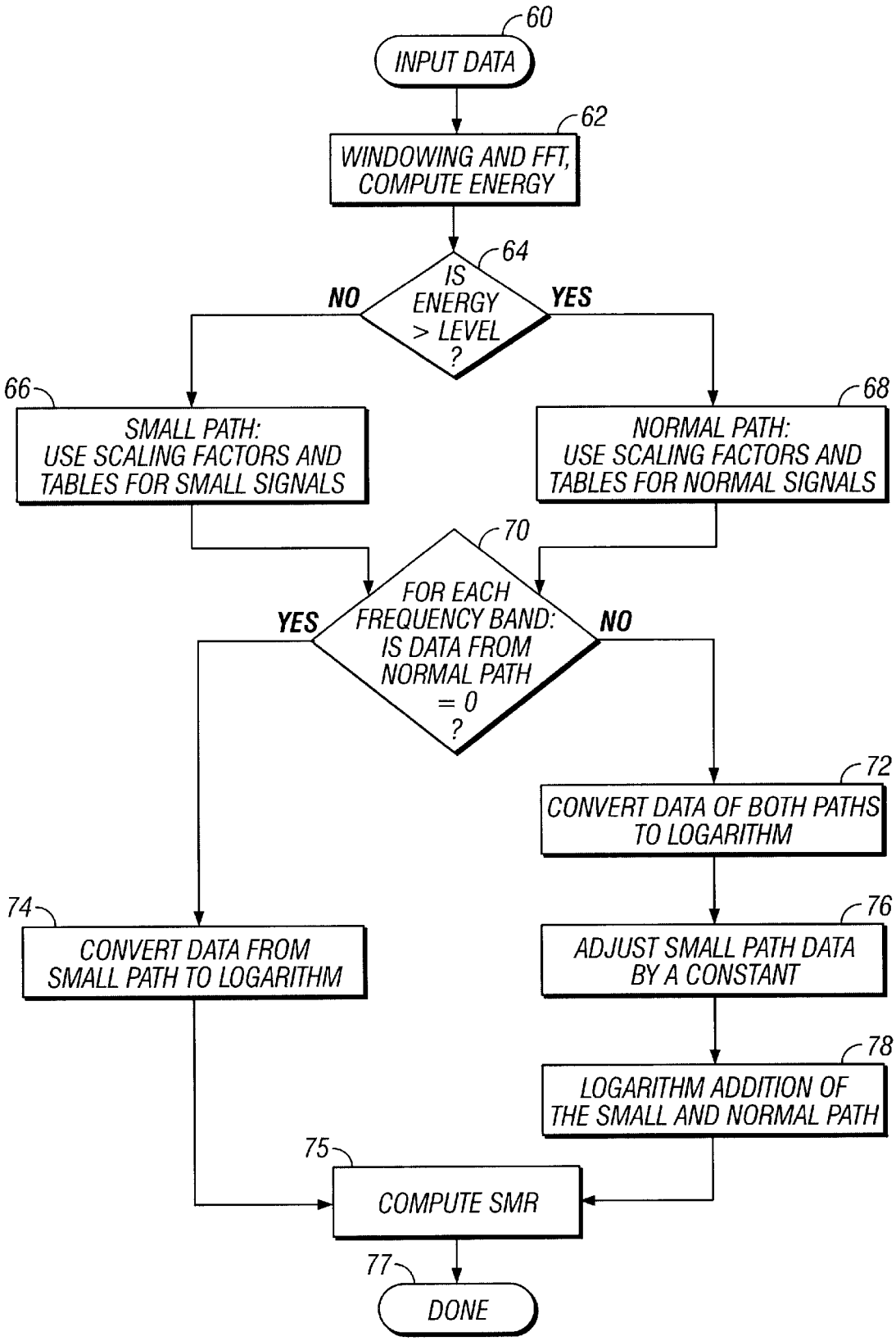
FIG. 4 shows a flowchart outlining various steps in determining the masking thresholds, in accordance with the present invention.

Referring now to FIG. 4, a flowchart outlining a new approach to determining the masking thresholds of a psychoacoustic model 2 is shown, in accordance to the present invention. The output of a psychacoustic model 2 is in the form of signal to mask ratios (SMR) which represent the masking threshold. In determining the SMR, absolute threshold values for each spectral line or group of lines has to be read from a set of tables in the MPEG Standard. Tables D.4*a*, D.4*b* and D.4*c* in the MPEG Standard provide the absolute threshold values foe spectral lines or group thereof as indexed by frequency. However, the input data, in most cases, has to be scaled initially so that the dynamic range of the input data falls within the dynamic range of the DSP architecture used in the encoder. In most cases scaling is necessary since most fixed-point DSP chips commonly in use have 16 or 24 bits of data width while the MPEG Standard requires 34 or more bits of digital representation covering a dynamic range of 101 dB (−5 dB to 96 dB with every bit covering 3 dB). Hence it becomes necessary to scale down larger input signals in order to avoid clipping or overflowing of the input data beyond the dynamic range of the DSP architecture.

The major limitation of employing one set of scaling factors, and consequently one table in the MPEG Standard, in determining the absolute threshold values lies in the fact that while larger input signals are attenuated, the weaker signal will have too few bits to represent them resulting in underflow of the input data and consequently poorer audio quality. The present invention overcomes such limitation by allowing the use of two sets of scaling factors, and hence two tables, in evaluating the absolute threshold values thereby accommodating a larger dynamic range of the input data. One implementation of the present invention is shown in FIG. 4 wherein the input data is read at step 60. At step 62, Hann windowing and FFT analysis are performed as described previously in FIG. 2. Subsequently, the energy of each input signal is computed based on the FFT analysis according to equation (2).

Having computed the energy level for each sample, the encoder makes a determination at step 64 as to whether the energy of the input signal is above a certain reference level or not. The reference level of energy to which the energy of the input signal is compared may be 54 dB. If the energy of the input signal is above the reference level, underflow is not a potential problem and a normal path is chosen wherein a scaling factor is used to scale down the input data in order to avoid any overflowing. Associated with the scaling factor in the normal path is a table therefrom the absolute threshold values are extracted.

However, if the energy of the input signal is below the reference level, i.e. from −5 dB to 54 dB, then overflow is not a potential problem and a small path is chosen as shown in step 66. In the small path a (much) larger scaling factor is used to scale up the input signal using a different table in order to ensure that there are enough bits to represent the data thereby avoiding any underflow problems.

The absolute threshold values are read from the two tables in their respective paths as indicated in steps 66 and 68. Results from the two paths are $epart_{nS}$, $npart_{nS}$, $epart_{nN}$, $npart_{nN}$ standing for energy from small path, threshold from small path, energy from normal path, and thresholds from normal path, respectively. The two paths are combined when computing SMR in the logarithm domain where 16 bits are enough to cover the entire dynamic range. If result from the normal path is zero when tested in step 70, the SMR, using data from small path only, is computed as $$SMR=10\ (\log(epart_{nS})-\log(npart_{nS})) \tag{17}$$

in step 74 and step 75, where log denotes logarithm to the base 10. If both $epart_{nN}$ and $npart_{nN}$ are nonzero, at step 72 and step 76, energy and threshold from both paths will be converted to logarithm with the small path adjusted by a constant to offset the effect of large scaling factor in the small path according to $$dB_{eN}=10\ \log(epart_{nN}) \tag{18}$$

$$dB_{nN}=10\ \log(npart_{nN}) \tag{19}$$

$$dB_{eS}=10\ \log(epart_{nS})-constant \tag{20}$$

$$dB_{nS}=10\ \log(npart_{nS})-constant \tag{21}$$

Then at step 78, contributions from both paths are combined $$dB_e=10\ \log(10^{dBeS/10}+10^{dBeN/10}) \tag{22}$$

$$dB_n=10\ \log(10^{dBnS/10}+10^{dBnN/10}) \tag{23}$$

Equations (22) and (23) can be approximated by referring to the table of logarithm addition. SMR is then computed at step 75 for each of the 32 frequency bands by $$SMR=dB_e-dB_n \tag{24}$$

Some of the equations (18)–(23) are not required if either $epart_{nN}$ or $npart_{nN}$ is zero and the other is not. For example, if $epart_{nN}$ is zero then $dB_e=dB_{es}$ and equation (22) is no longer required since combining contributions from both paths is not necessary.

Step 77 indicates that the process of determining the SMR for the input data has ended successfully. Using the present invention, the entire dynamic range of the input data is preserved by employing two tables rather than one as is currently practiced. Employing two tables, according to the present invention, requires extra memory space for the encoder, however, since the entire dynamic range of the input data is preserved the compression/decompression process results in improved audio quality without compromising efficiency.

The new approach to encoding presented hereinabove, in accordance to the present invention, may be implemented in any device which uses the psychoacoustic model 2 in the encoding process. Such devices include but are not restricted to compact disk (CD) recorders, digital versatile disk (DVD) audio recorders, personal computer (PC) software encoding audio, etc.

Figure 5:
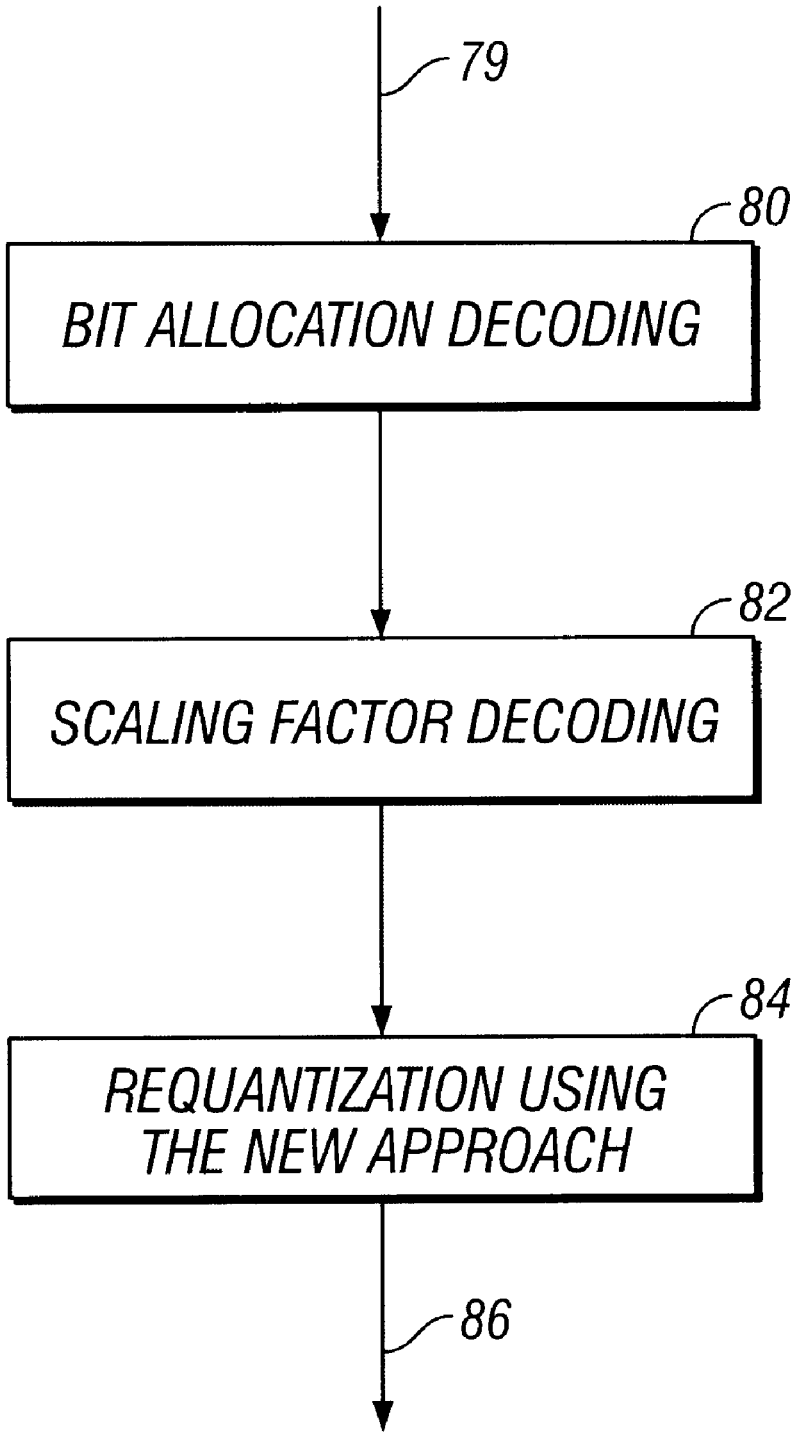
FIG. 5 illustrates a flowchart outlining various steps in the reconstruction part of the decoding process, in accordance with the present invention.

Referring now to FIG. 5, a flowchart outlining various steps in the reconstruction part of the decoding process is shown. The flowchart corresponding to the decoding process was shown in FIG. 1(*b*) to include three main steps one of which is the reconstruction step 28. A new approach to the reconstruction step is shown in FIG. 5, according to an implementation of the present invention, whereby considerable reduction is gained in the amount of memory required for decoding, resulting in improved efficiency and lower costs.

Encoded data in the form of bitstream 79 is provided to the reconstruction step of the decoding process after having been processed at the frame unpacking step 26. The first step in reconstruction is the bit allocation decoding 80 wherein the decoding of the information specifying the number of bits allocated to each subband is performed. Initially the number of bits of information for each subband, designated as 'nbal' and having values of 2, 3 or 4, are read from the bitstream. Subsequently, the Layer II tables B.2 in the MPEG Standard are used in order to find a number 'nlevel' employed in quantizing the samples in each subband. The number 'nlevel' is located in the tables by using the number 'nbal' and the number of the subband as indices. There are four Layer II tables B.2 in the MPEG Standard each having 16 by 32 entries. The four different tables correspond to different bit rates and sampling frequencies.

In the prior art, once the 'nlevel', indicating the number of quantization levels, has been determined another 16 by 4 table, B.4, in the MPEG Standard is used to determine such information as the number of bits used to code the quantized samples, the requantization coefficients, and whether or not the code for three consecutive subband samples have been grouped as one code. Therefore, to every entry in each of the Layer II B.2 tables corresponds five entries making a total of 16 times 32 times 5 or 2,560 entries. There are four Layer II B.2 tables resulting in four sets of 2,560 entries to be stored in the decoder's memory or in an external memory used in the decoding process. Such a large storage capacity represents additional cost and space associated with the current decoders. The present invention reduces the storage capacity required for the reconstruction part of the decoding by almost a factor of four as discussed hereinbelow.

In the scaling factor decoding step 82, the coded scaling factors corresponding to each subband with a nonzero bit allocation are read by the decoder from the bitstream. The six bits of a coded scaling factor within the bitstream represent an integer index which is used in the Layer II table B.1 of the MPEG Standard to obtain the scaling factor for a particular subband. The scaling factor for each subband is used to multiply the subband sample after requantization.

In step 84 requantization of the subband samples is performed using a new approach, in accordance with the present invention. The present invention takes advantage of the fact that in the Layer II B.2 tables there are only seventeen distinct quantization levels. The quantization level number 'nlevel', also known as the quantization step, is used to compute a quantization index as follows:

| Quantization index | guantization step |
|---|---|
| 0 | 3 |
| 1 | 5 |
| 2 | 7 |
| 3 | 9 |

The quantization indices for the remaining quantization steps (from 15 to 65535) are calculated by the formula $$\text{quantization index}=\log_2(\text{quantization step}+1) \tag{25}$$

where $\log_2$ represents logarithm to the base 2.

Subsequently, using a single 16 by 4 table for each of the quantization indices such information as: 1) requantization coefficients C and D, 2)whether or not the codes for three consecutive subband samples have been grouped as one code, 3) the number of bits used to code the quantized samples is obtained. Hence the data to be stored within the memory of the decoder, using the present invention, is included within four 16 by 32 tables and a single 17 by 4 table. Accordingly, the quantity of data to be stored is almost one fourth of what needs to be stored for decoding using the prior art methods. FIG. 6 illustrates the 17 by 4 table described hereinabove employing the quantization index to obtain information relevant to requantization. More specifically, requantization coefficients C and D, the grouping/samples per codeword, and the codeword length are given in the table in FIG. 6 for various values of the quantization index. In the present invention, the table in FIG. 6 replaces the Layer II table B.4 of the MPEG Standard.

If the data sample obtained from the bitstream is denoted by s'", the requantized value of the same samples may be obtained as $$s''=C(s'''+D) \tag{26}$$

where C and D are the requantization coefficients obtained from the table in FIG. 6. The requantized value S" has to be scaled using an appropriate scaling factor. If s' denotes the rescaled value then $$s'=(\text{scaling factor})s'' \tag{27}$$

Figure 1A:
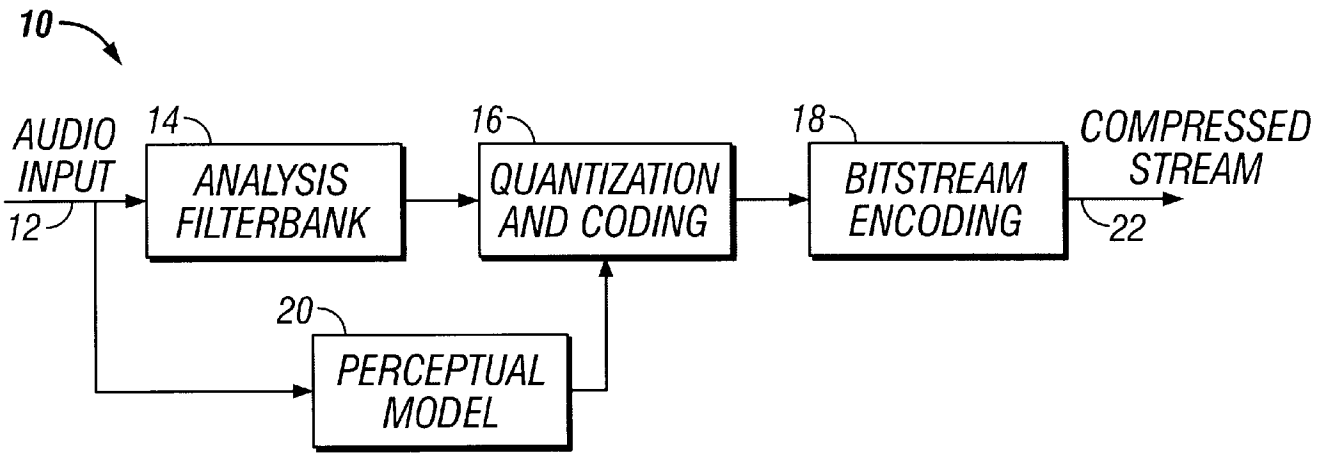
FIG. 1(a) (Prior Art)
FIG. 1(*a*) shows a block diagram of a prior art MPEG encoder.
Figure 1B:
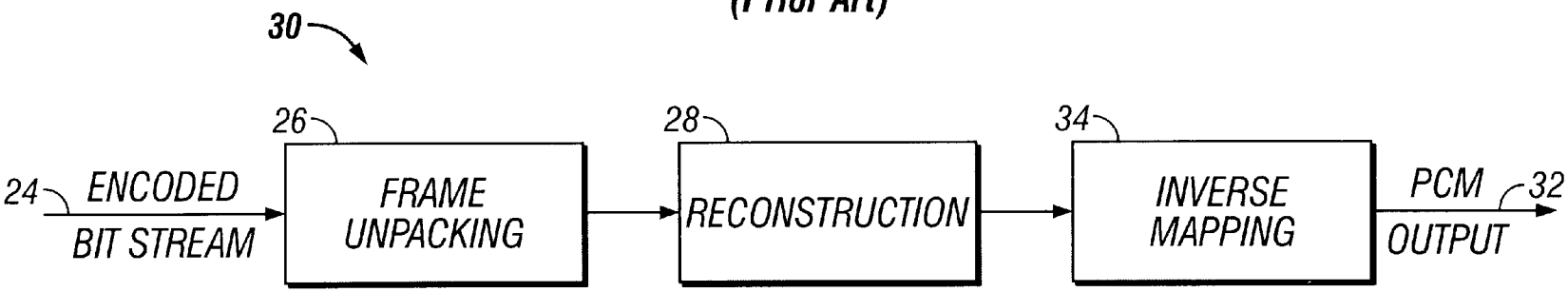
FIG. 1(b) (Prior Art)

The rescaled values s', labeled in FIG. 5 as 86, are used as the subband audio samples in the subsequent inverse mapping step of the decoding process as previously shown in FIG. 1(*b*).

The MPEG encoder/decoder is implemented on an integrated circuit (IC) chip equipped with an internal memory. While processing audio signals the internal memory of the IC chip is used. In the event the internal memory of the IC chip is not adequate for storage of data an external memory is made available. The external memory is typically in the form of an SDRAM chip, which is in communication with the IC chip. While processing audio signals when the internal memory of the IC chip is not adequate the data is transmitted to the SDRAM and at a later time data is retrieved from the SDRAM for further processing. In this manner there is a back and forth movement of data between the internal and external memories whenever the internal memory alone is not adequate for storage of data. Using the method described hereinabove, in accordance with the present invention, the use of memory is significantly reduced resulting in lower costs. Finally, the new approach to decoding presented hereinabove may be implemented in any device using the psychoacoustic model 2 in the decoding process. Such devices may include, but are not restricted to, CD recorders, DVD audio recorders, PC software encoding audio, etc.

Although the present invention has been described in terms of specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A communication system comprising:

an encoder circuit responsive to an audio signal for performing compression on the audio signal and adaptive to generate an audio output signal based upon the compressed audio signal, the encoder circuit for sampling the audio signal to generated sampled signals, each sampled signals having a real and an imaginary component associated therewith, each sampled signal having an energy and a phase defined within a current block and each sampled signal having being transformed to have a real and an imaginary component, a previous block preceding the current block and a block preceding the previous block, the encoder circuit for calculating the phase of the samples of the current block using the real and the imaginary components of the samples of the previous block and the block preceding the previous block, wherein calculations for determining the unpredictability measure is reduced by avoiding trigonometric calculations of the samples signals of the current block thereby improving system performance wherein the encoder circuit for calculating the unpredictability measure, $c_w$, using the following equations:

$c_w=[\text{temp}\mathbf{5}-2.0\ \rho_w(\text{temp}\mathbf{4})]^{1/2}/(\text{temp}\mathbf{3})$, wherein temp5 is calculated as follows:

$\text{temp}\mathbf{5}=r_w^2+\rho_w^2$ and temp4 is calculated as follows:

$\text{temp}\mathbf{4}=(\text{temp}\mathbf{1})x_r(w)+(\text{temp}\mathbf{2})x_j(w)$ and temp3 is calculated as:

$\text{temp}\mathbf{3}=r_w+\text{abs}(\rho_w)$ and wherein temp2 is calculated as:

$\text{temp}\mathbf{2}=(\sin 2f_w[t\text{-}1])(\cos f_w[t\text{-}2])-(\cos 2f_w[t\text{-}1])(\sin f_w[t\text{-}2])$ and wherein temp1 is calculated as:

$\text{temp}\mathbf{1}=(\cos 2f_w[t\text{-}1])(\cos f_w[t\text{-}2])+(\sin 2f_w[t\text{-}1])(\sin f_w[t\text{-}2])$ wherein $r_w$ is the square root of the energy of the sampled signal at the current block, $f_w[t\text{-}1]$ and $f_w[t\text{-}2]$ are the phase of the sampled signal at the previous block preceding the unsent block and the block preceding the previous block, respectively, $x_r(w)$ and $x_j(w)$ are the real and imaginary components of the sampled signals, respectively, and $\rho_w$ is the predictability value of the square root of the energy at the current block.

2. A communication system as recited in claim 1 wherein the encoder circuit further for performing fast fourier transform to generate the real and imaginary components.

3. A communication system as recited in claim 2 wherein the transformed samples are functions of frequency.

4. A communication system as recited in claim 3 wherein the current block includes the current value of the phase and energy of the sampled signal at a predetermined frequency.

5. A communication system as recited in claim 3 wherein the encoder circuit further includes a filter bank means having a plurality of bandpass filters for converting the audio signal from time domain to frequency domain wherein a plurality of subband samples are generated.

6. A communication system as recited in claim 1 wherein the $\rho_w$ has an absolute value abs ($\rho_w$) and is:

$$\rho_w(t)=2.0\ r_w(t\text{-}1)-r_w(t\text{-}2)$$

wherein $r_w(t\text{-}1)$ and $r_w(t\text{-}2)$ are the square root of the energy of the sampled signal at the previous block and the block preceding the previous block.

7. A communication system as recited in claim 6 wherein the encoder circuit for calculating cos $2f_w[t\text{-}1]$ and sin $2f_w[t\text{-}1]$ using the following equations:

$$\cos 2f_w[t\text{-}1]=2(x_r(w)[t\text{--}1])^2/(r_w[t\text{-}1])^2-1,$$

$$\sin 2f_w[t\text{-}1]=2(x_r(w)[t\text{-}1])(x_j(w)[t\text{-}1])/(r_w[t\text{-}1])^2.$$

8. A communication system as recited in claim 6 wherein the encoder circuit including a perceptual model for computing masking thresholds, said encoder circuit further including a quantization means responsive to said subband samples for quantizing the subband samples thereby reducing quantization noise.

9. A communication system comprising:

an encoder circuit responsive to an input audio signal and operative to generate an output signal in the form of compressed bit stream, said encoder circuit including a perceptual model for computing masking threshold represented by signal-to-mask ratios using a first table and a second table for generating scaling factors wherein the first table has values which are utilized to generate the scaling factors for attenuating normal-level input audio signals and the second table has other value which are utilized to generate the other scaling factors for attenuating weaker-level input audio signals thereby covering a large dynamic range associated with the input audio signal; and wherein the encoder circuit further for sampling the input audio signal wherein the sampled input signal has associated therewith energy level and for comparing the energy level of the sampled input signal to a reference energy level for selecting one of the first and second tables to use; and wherein when the normal-level input audio signals are equal to zero, then signal-to-mask ratios (SMR) are computed according to the following equation:

$$SMR=10(\log(epart_{nS})-\log(npart_{nS}))\text{ wherein:}$$

$epart_{nS}$ is an energy level associated with the weaker-level input audio signals and $npart_{nS}$ is a threshold level associated with the weaker-level input audio signals.

10. A communication system as recited in claim 9 wherein each of said tables is associated with one scaling factor.

11. A communication system as recited in claim 10 wherein associated with a first scaling factor and said second table is associated with a second scaling factor and if the result of the comparison yields the energy level of the sampled input signal to be larger than the reference energy level, the first scaling factor is used to reduce the input signal level thereby generating a reduced input signal level and if the result of the comparison yields the energy level of the sampled input signal to be smaller than the reference energy level, the second scaling factor is used to enlarge the input signal level thereby generating an enlarged input signal level.

12. A communication system as recited in claim 11 wherein each table includes threshold values for determining the signal-to-mask ratios.

13. A communication system as recited in claim 12 wherein the reconstruction means for determining requantization coefficients using the quantization indices.

14. A communication system as recited in claim 9 wherein the encoder circuit further for sampling the input audio signal wherein the sampled input signal has associated therewith energy level and for comparing the energy level of the sampled input signal to a reference energy level for selecting one of the first and second table to use.

15. A communication system as recited in claim 14 wherein the encoder further combines the reduced and enlarged signal levels for computing signal-to-mask ratios (SMR).

16. A communication system as recited in claim 15 wherein the SMR is calculated in accordance with the following equation:

$$SMR=dB_e-dB_n\text{, wherein:}$$

$$dB_e=10\log(10^{dBeS/10}+10^{dBeN/10});$$

$$dB_n=10\log(10^{dBnS/10}+10^{dBnN/10});$$

$$dB_{eN}=10\log(epart_{nN});$$

$$dB_{nN}=10\log(npart_{nN});$$

$$dB_{eS}=10\log(epart_{nS})-\text{constant; and}$$

$$dB_{nS}=10\log(npart_{nS})-\text{constant; and}$$

wherein constant is to offset an effect of a larger scaling factor associated with the weaker-level input audio signals, $epart_{nN}$ is an energy level associated with the normal-level input audio signal, $npart_{nN}$ is a threshold level associated with the normal-level input audio signal, $epart_{nS}$ is another energy level associated with the weaker-level input audio signals, and $npart_{nS}$ is another threshold level associated with the weaker-level input audio signals.

17. A communication system as recited in claim 15 wherein the encoder circuit further for converting the reduced and enlarged signal levels to logarithmic form and further for adjusting the logarithmic reduced signal by a predetermined constant.

18. A communication system as recited in claim 17 wherein each subband samples has associated therewith a code, the reconstruction means for determining whether or not codes for consecutive subband samples are grouped as one code using the quantization indices.

19. A communication system comprising:

a decoder circuit responsive to subband samples of an audio signal and operative to generate a pulse code modulated audio signal, the decoder circuit including reconstruction means for receiving the subband samples and for requantizing the subband samples using quantization indices determined from quantization levels using a table to determine the first three quantization indices and a formula to determine the remaining quantization indices; and wherein the quantization indices directly index the quantization levels from one set of quantizing tables to other quantizing information of another quantizing table thereby eliminating a need for the another quantizing table; and wherein the formula is:

$$\text{quantization index}=\log_2(\text{quantization level}+1)\text{, wherein:}$$

quantization index is one of the quantization indices; quantization level is one of the quantization levels; and $\log_2$ is a base 2 logarithm operation.

20. A communication system as recited in claim 19 wherein the reconstruction means for determining the number of bits for quantization of samples using the quantization indices.

21. A communication system as recited in claim 19 wherein:

the quantizing tables are MPEG Layer II tables B.2; and the another quantizing table is an MPEG Layer II table B.4.

22. A communication system comprising:

an encoder circuit responsive to an input audio signal and operative to generate an output signal in the form of compressed bit stream, said encoder circuit including a perceptual model for computing masking threshold represented by signal-to-mask ratios using a first table and a second table for generating scaling factors wherein the first table has values which are utilized to generate the scaling factors for attenuating normal-level input audio signals and the second table has other values which are utilized to generate the other scaling factors for attenuating weaker-level input audio signals thereby covering a large dynamic range associated with the input audio signal; and wherein the encoder circuit further for sampling the input audio signal wherein the sampled input signal has associated therewith energy level and for comparing the energy level of the sampled input signal to a reference energy level for selecting one of the first and second tables to use;

wherein the encoder further combines the reduced and enlarged signal levels for computing signal-to-mask ratios (SMR); and wherein the SMR is calculated in accordance with the following equation:

$SMR=dB_e-dB_n$, wherein:

$dB_e=10\log(10^{dBeS/10}+10^{dBeN/10})$;

$dB_n=10\log(10^{dBnS/10}+10^{dBnN/10})$;

$dB_{eN}=10\log(epart_{nN})$;

$dB_{nN}=10\log(npart_{nN})$;

$dB_{eS}=10\log(epart_{nS})-constant$; and $dB_{nS}=10\log(npart_{nS})-constant$; and wherein constant is to offset an effect of a larger scaling factor associated with the weaker-level input audio signals, $epart_{nN}$ is an energy level associated with the normal-level input audio signals, $npart_{nN}$ is a threshold level associated with the normal-level input audio signals, $epart_{nS}$ is another energy level associated with the weaker-level input audio signals, and $npart_{nS}$ is another threshold level associated with the weaker-level input audio signals.

* * * * *